US006302514B1

(12) United States Patent
Eade et al.

(10) Patent No.: US 6,302,514 B1
(45) Date of Patent: Oct. 16, 2001

(54) METHOD AND APPARATUS FOR AUTOMATICALLY CORRECTING THE FIRE TIMING OF A PRINTHEAD CARRIER DUE TO LINEAR ENCODER VELOCITY ERRORS

(75) Inventors: Thomas Jon Eade, Lexington; Darrel Lee Henry, Versailles, both of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/390,864

(22) Filed: Sep. 3, 1999

(51) Int. Cl.[7] ..... B41J 23/00
(52) U.S. Cl. ..... 347/33; 347/14
(58) Field of Search ..... 347/9, 14, 19, 347/37; 400/322, 903

(56) References Cited

U.S. PATENT DOCUMENTS 5,861,726 * 1/1999 Uchikata et al. ..... 318/685
5,936,645 * 8/1999 Niikura et al. ..... 347/14

* cited by examiner

*Primary Examiner*—John Barlow
*Assistant Examiner*—Craig A. Hallacher
(74) *Attorney, Agent, or Firm*—Frederick H. Gribbell

(57) ABSTRACT

An improved ink jet printer is provided in which its carrier position and velocity information is derived from a linear optical encoder mounted on the carrier, which produces the position information uses a quadrature output signal, and one of the channels of that output signal is used to determine "critical edge" transitions used to provide the actual print fire timing. Two adjacent encoder periods are needed to determine the acceleration of the carrier. By measuring the time intervals of these two encoder periods, and measuring the difference between these time intervals, the present invention provides correction logic that can determine if the second of the two measurements has been corrupted by motion not relative to carrier speed across the print media. If the difference between the previous two periods is greater than a preset maximum, the correction logic will limit the new encoder time (i.e., for purposes of fire pulse width calculation) to the old encoder time, plus or minus the preset limit. In this manner, any significantly large errors in the critical edges of the encoder signals can be temporarily ignored for the fire pulse calculations of the next encoder period, at least within the programmable preset limits. This is particularly useful during printing operations during which the carrier should be traveling at a relatively constant velocity, wherein the false edges that may occur otherwise would significantly degrade the placement of printed pels on the print media if not for the automatic self-correction provided by the present invention.

23 Claims, 5 Drawing Sheets

METHOD AND APPARATUS FOR AUTOMATICALLY CORRECTING THE FIRE TIMING OF A PRINTHEAD CARRIER DUE TO LINEAR ENCODER VELOCITY ERRORS

TECHNICAL FIELD

The present invention relates generally to image forming equipment and is particularly directed to an ink jet printer of the type which uses an optical encoder for carrier position and velocity information. The invention is specifically disclosed as an automatic correction circuit that limits the effect, on print fire timing, of the encoder signal when its most recent time interval is beyond a predetermined tolerance as compared to its previous time interval.

BACKGROUND OF THE INVENTION

Serial line printers that incorporate a moving printhead carrier generally use some type of linear position encoder to provide closed-loop position control for the carrier. It is often desirable to print individual pixels or pels at a resolution greater than the fundamental resolution of the encoder. One conventional technique uses a quadrature signal developed from the base encoder to produce a four-times increase in resolution. While this approach is sufficient to provide high-resolution position information, it lacks the necessary accuracy to generate high-resolution fire pulse timing for the printhead. Typical tolerance values for a quadrature sensor are ±10 degrees on channel phase, and ±15% on duty cycle. These encoder output tolerances force the system designer to use the linear encoder fundamental signal as the base frequency for fire pulse generation.

The derivation of print fire pulse timing from carrier velocity measurements is subject to error from sudden changes in velocity over the distance of the encoder fundamental signal's period. For purposes of print fire pulse derivation, a single period of history of the quadrature signal must be used to provide pulses for the next encoder period. This technique is reliable as long as high frequency perturbations in the velocity do not result in the period being reduced or increased by a significant amount.

If the encoder, for example, produces 150 pulses per inch and the maximum desired print registration or resolution is 1200 pixels (or pels) per inch, the controlling logic must generate eight evenly spaced intervals within the 1/150-inch pulse window as the first step in developing the print fire timing. Individual printing elements, represented by ink jet nozzles in an array, are conventionally staggered within a single pel spacing to minimize the number of elements (i.e., nozzles) that must simultaneously fire. This reduces power requirements and aids in thermal management and fluid dynamics for the ink jet nozzles.

As a result of this nozzle stagger, each of the eight single pel print times must be subdivided into a much larger number of equal time intervals to segregate the specific elements according to their physical locations on the ink jet printhead. Thus, the nozzles are fired over a time lapse based upon the printhead carrier velocity which renders a vertical column on the media from the staggered nozzle array column on the printhead. Margin for error is built in to the system by the fact that some of the available time intervals during the individual pel print times are not needed to fire all of the nozzles.

In an example system of an eight-times expansion in precision to 1200 dpi, a collision between the fire pulses may occur if a subsequent 1/150-inch pulse window time period decreases by more than 12.5% from the previous 1/150-inch measurement. A very large acceleration is necessary to produce such a change in velocity for a typical carrier speed of twenty inches per second (ips), and most printers incorporate a motor system that does not have enough power to produce this acceleration. While this large error is necessary to cause collision between adjacent fire pulses, the drop placement accuracy is effected as soon as the increase in velocity brings the next encoder edge into the final fire window of the previous slice, which will then conflict with the first fire window of the next slice.

In addition, as the carrier moves across the print media, it can experience a rotational motion with respect to the carrier shaft. This rotational motion can cause the encoder strip sensor to see some additional acceleration in the direction of travel of the carrier, resulting from the vibration of the carrier. This new motion is translated into a high frequency disturbance in the velocity. Resultant fire pulse window calculations from such "false" encoder edges can result in pulse timing inaccuracy, and consequently defects in the print-out.

It would be a significant advantage to provide an ink jet printer that can "self-correct" the timing calculations based upon a practical range of carrier acceleration.

SUMMARY OF THE INVENTION

Accordingly, it is a primary advantage of the present invention to provide a programmable self-correcting system for fire pulse calculation based upon signals from a linear encoder system of an image forming apparatus, such as an ink jet printer. It would be a further advantage of the present invention to provide a self-correcting system for fire pulse calculations of an ink jet printer which can selectively ignore "false" transitions of a quadrature linear encoder signal, while maintaining a minimum output fire pulse time signal for the individual nozzles.

Additional advantages and other novel features of the invention will be set forth in part in the description that follows and in part will become apparent to those skilled in the art upon examination of the following or may be learned with the practice of the invention.

To achieve the foregoing and other advantages, and in accordance with one aspect of the present invention, an improved image forming apparatus is provided which includes an ink jet carrier having an array of nozzles with a fire pulse timing circuit that is based upon information gleaned from a linear encoder that measures position and velocity of the carrier along its carrier shaft. The optical encoder that produces the position information uses a quadrature output signal, and one of the channels of that output signal is used to determine "critical edge" transitions that are used to provide the actual print fire timing. Two adjacent encoder periods are needed to determine the acceleration of the carrier. By measuring the time intervals of these two encoder periods, and measuring the difference between these time intervals, the present invention provides correction logic that can determine if the second of the two measurements has been corrupted by motion not relative to carrier speed across the print media.

The correction logic compares the absolute value of the difference between the encoder periods to a programmable number that has been set according to system parameters (including the print resolution being used for a particular document). If the difference between the previous two periods is greater than the preset maximum, the correction logic will limit the new encoder time (i.e., for purposes of fire pulse width calculation) to the old encoder time, plus or minus (plus/minus) the preset limit. In this manner, any significantly large errors in the critical edges of the encoder signals can be temporarily ignored for the fire pulse calculations of the next encoder period, at least within the programmable preset limits. This is particularly useful during printing operations during which the carrier should be traveling at a relatively constant velocity, wherein the false edges that may occur otherwise would significantly degrade the placement of printed pels on the print media if not for the automatic self-correction provided by the present invention.

Still other advantages of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE PREFERRED EMBODIMENT

Reference will now be made in detail to the present preferred embodiment of the invention, an example of which is illustrated in the accompanying drawings, wherein like numerals indicate the same elements throughout the views.

Figure 1:
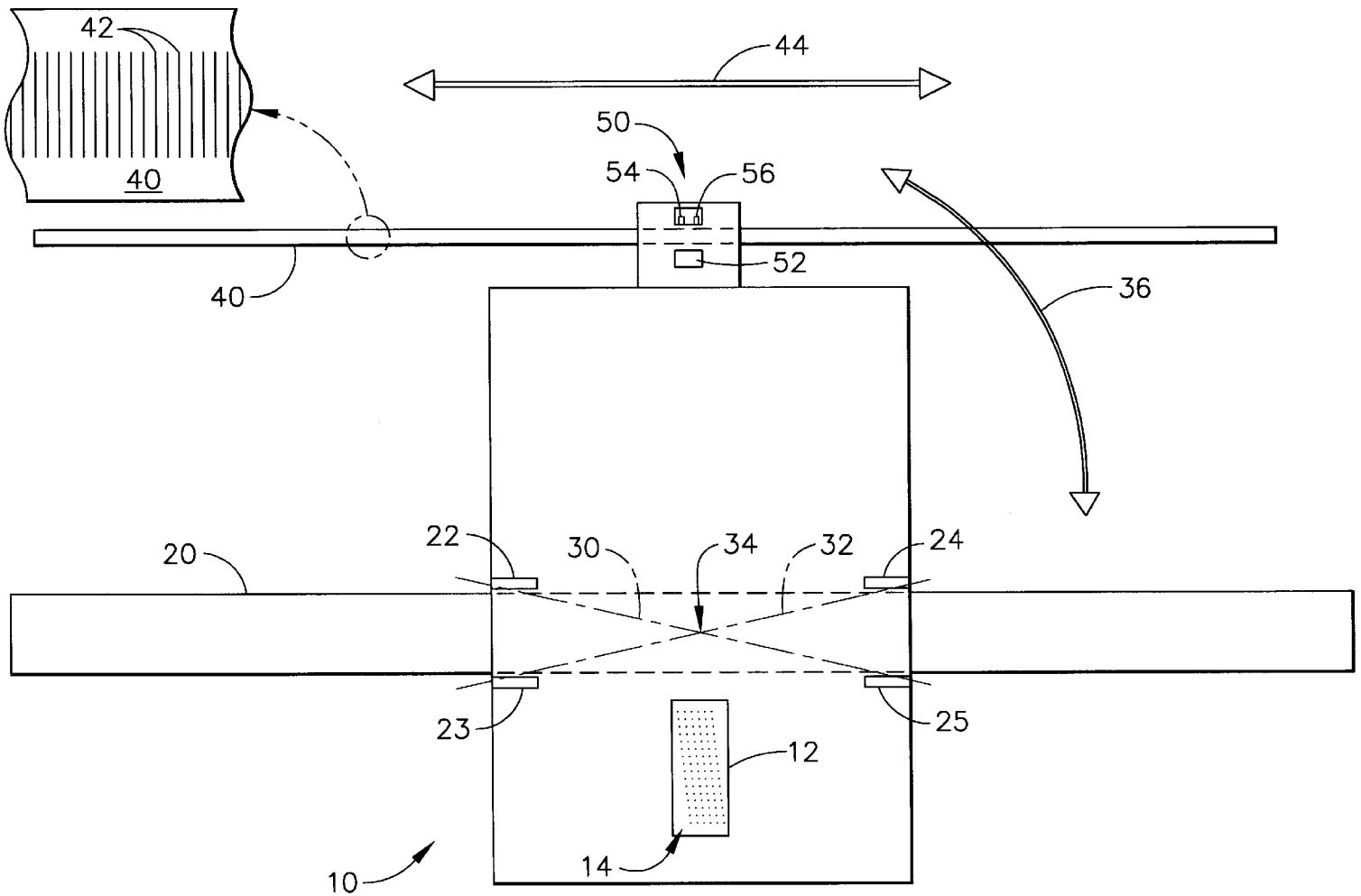
FIG. 1 is a top plan view in diagrammatic form of a carrier sub-assembly of an ink jet printer, as constructed according to the principles of the present invention.

Referring now to the drawings, FIG. 1 illustrates a typical ink jet printer carrier mechanism in a top plan view, in which the carrier is generally designated by the reference numeral 10. An ink jet cartridge (not shown separately) will typically be mounted on carrier 10, and will include an array 12 of individual ink jet nozzles 14. In most installations, the nozzles are pointing downward, and would typically be hidden in this view.

The carrier 10 is driven along a carrier shaft 20, and bearings are used to support the carrier 10 during this sliding motion. The bearings are illustrated diagrammatically by the reference numerals 22, 23, 24, and 25, which in this view each numeral represents a bearing half cross-section.

As carrier 10 slides along the carrier shaft 20, it is possible for the carrier 10 to somewhat exhibit a rotational motion that will have the effect of a wobble as it moves along the carrier shaft. This wobble is mainly due to play in the bearings, and this play is due to the clearance tolerance of the bearings when new, and also due to a certain amount of wear over the life of the bearings. If the bearings 22–25 exhibit a uniform tolerance, then the wobble would tend to be along the axes 30 and 32, which intersect at the imaginary point 34. Of course, if one bearing (e.g., bearing 22, 23) exhibits a greater tolerance or greater wear, then the intersection of the wobble axis could be shifted to either the right or left (on FIG. 1) of this point 34. In any event, this wobble will be manifested as a rotational motion on the shaft bearings, and that rotational motion will be along the curved line 36 on FIG. 1.

A typical ink jet printer will contain a linear encoder strip, such as the strip represented by the reference numeral 40. The encoder strip 40 can be made either of plastic or of metal, and in the case of a metal strip, would include a large number of very fine vertical slits when the strip is oriented in a horizontal direction. These vertical slits are generally designated by the reference numeral 42 on a magnified view as part of FIG. 1. In a typical ink jet printer, there would be one hundred fifty (150) such vertical slits per inch of the linear encoder strip 40. Since these vertical slits 42 are used for determining the position of the carrier along carrier shaft 20, it is very important that these slits 42 be both uniform in size and shape, as well as uniform in distance between one another.

The primary carrier motion is illustrated on FIG. 1 by the line 44, having arrows in both the right and left directions on this Figure. An optical encoder sensor, generally given the reference numeral 50, is used to detect when the carrier 10 is passing each particular slit 42 of the linear encoder strip 40. At least one light emitting diode (LED) is located at 52, and a pair of photodiodes 54 and 56 are used to detect the light in the form of pulses, as light travels through the moving slits 42 and arrives at these photodiodes 54 and 56.

In a preferred Lexmark ink jet printer, the carrier 10 moves in the horizontal direction at approximately 20 inches per second (ips) during a printing operation, and since there are 150 slits 42 in the encoder strip 40, each of the photodiodes 54 and 56 will receive 3,000 pulses per second while the carrier is moving at this speed.

It is preferred to use a quadrature waveform generator as the electrical output of the encoder sensor 50, and moreover, it is preferred that each of the two channels that are output by the encoder sensor 50 are to have approximately a 50% duty cycle. A nominal waveform for one of these channel outputs would have the appearance of the graph "W1" on FIG. 2. As long as the carrier 10 is moving at a constant horizontal velocity, and there are no unusual acceleration or deceleration forces occurring at a particular time, an electrical signal having the appearance of the nominal waveform W1 should be output from the encoder sensor for one of its channels. At the 20 ips horizontal velocity, the frequency of waveform W1 would be 3,000 Hz, and the period of each cycle would be approximately 333 microseconds. On FIG. 2, the rising edge of W1 is indicated along a time axis (i.e., the X-axis on FIG. 2) as "T0," "T1," "T2," and "T3."

Assuming that the waveform W1 is "Channel A," then each of these rising edges at the time marks T0–T3 is a "critical edge" for the quadrature waveform being generated by the encoder sensor 50. At the time mark T1, for example, the waveform W1 exhibits a rising edge at the reference numeral 80.

Figure 2:
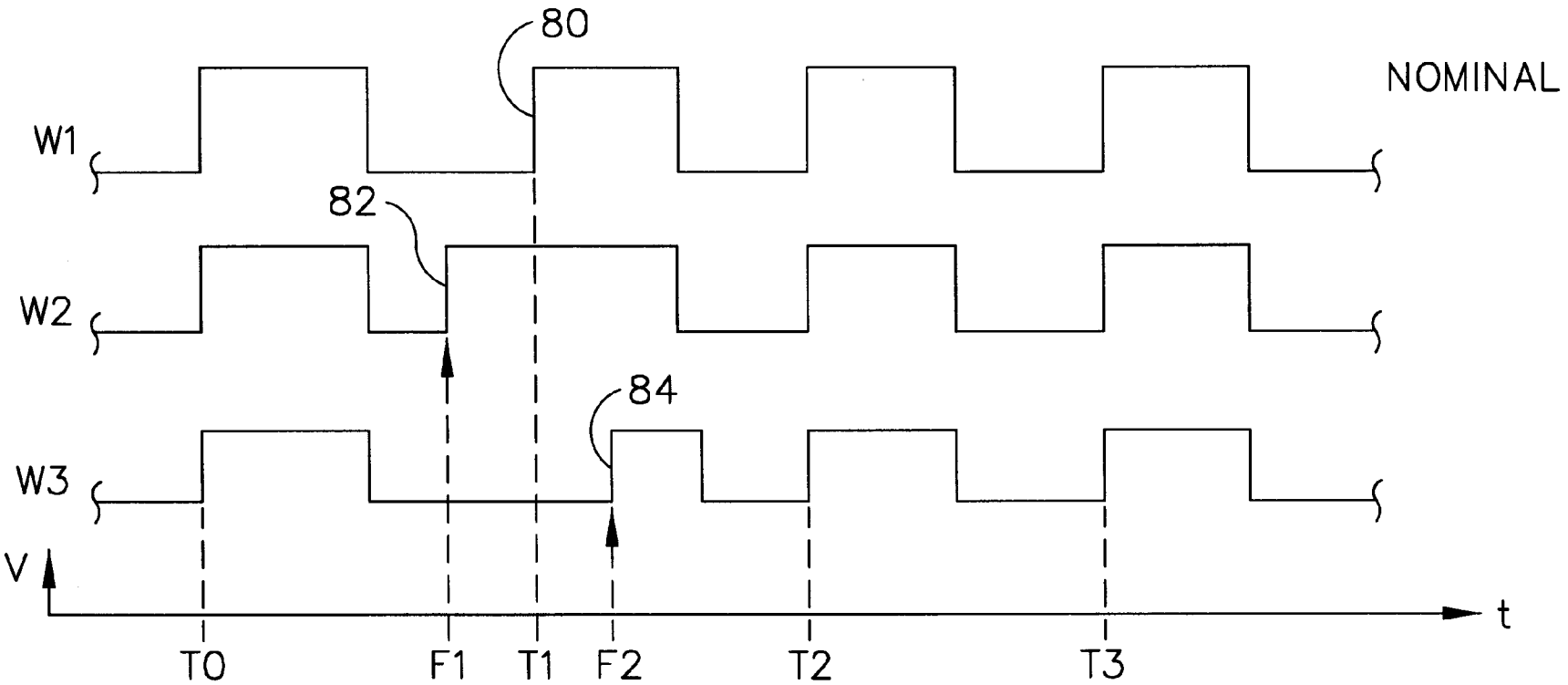
FIG. 2 is a graph depicting timing diagrams of waveforms generated by an optical encoder sensor of the ink jet printer of FIG. 1.

If the carrier exhibits a temporary rotational wobble (due to an acceleration force, or to some other mechanical condition), then the nominal waveform as depicted on the graph W1 could be modified to the waveform of either "W2" or "W3" as shown in FIG. 2. In the waveform W2, after the initial critical edge at T0, the next critical edge at 82 appears too early in time as a "false edge," which is depicted by the time mark "F1." In conventional prior art ink jet printers, the print timing would be entirely dependent upon this critical "false" edge at F1, and since the transition was very early, the printing of the next group of pels (i.e., "picture elements") would be quite early and would, therefore, be at an incorrect location on the printed page with respect to the previous group of pels that were printed based upon the waveform's critical edge at T0.

On the other hand, according to the waveform W3, the next critical edge after the first one at T0 would be the edge 84 at the time mark F2. In this circumstance, the anomaly in the carrier motion has caused the critical edge to be much too late, thereby also providing a "false edge." Also, in a prior art conventional printer, the print timing again would be thrown off by a fairly significant amount, and the pels would be printed too late in time, and therefore too far down the page with respect to the previous group of pels that were printed based upon the waveform's critical edge at T0.

The present invention keeps track of the timing between critical edges of the Channel A waveform, and prevents large displacements in the expected timing of the Channel A waveform from directly affecting the print timing, and therefore, compensates automatically for much of this error.

Figure 3:
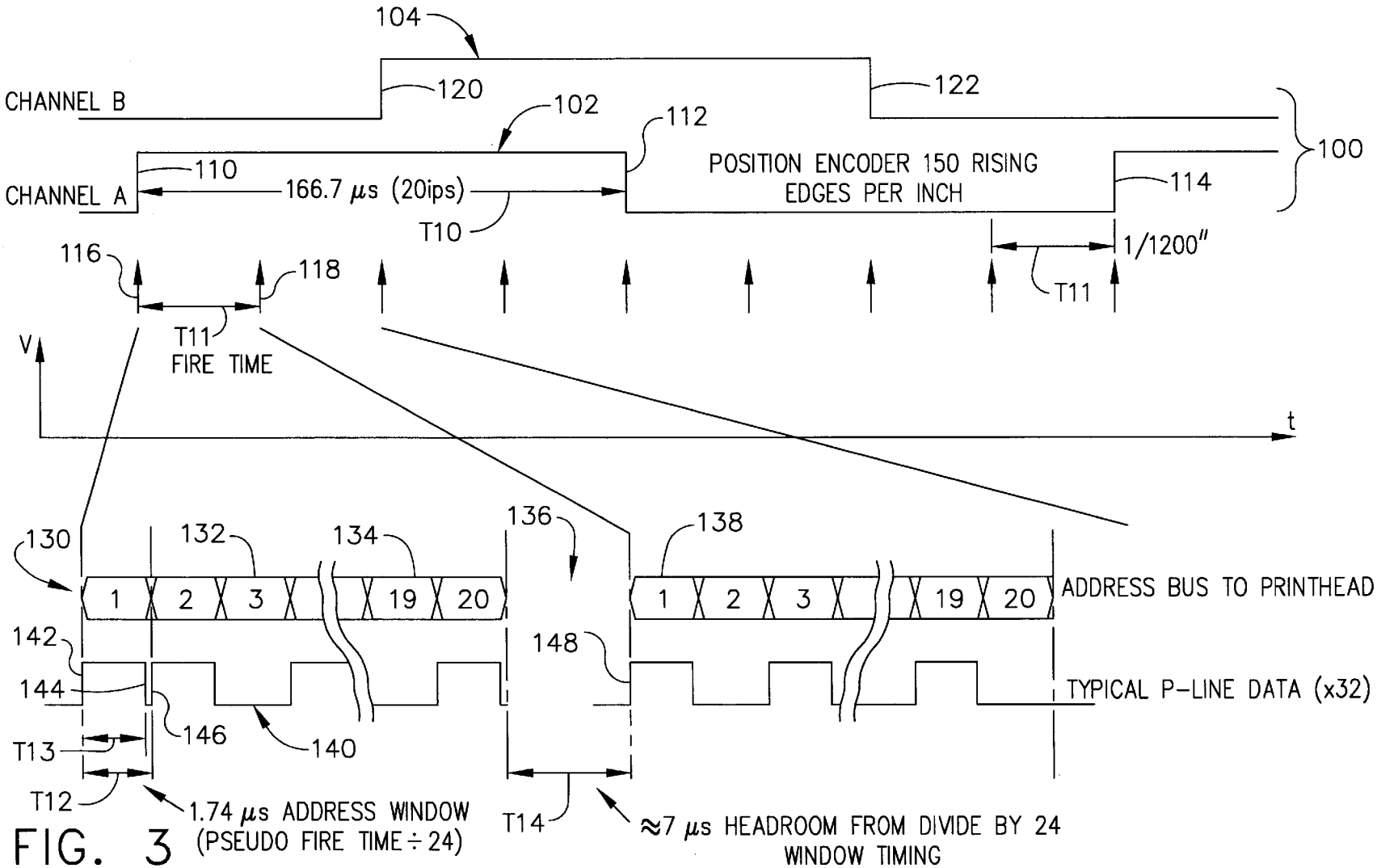
FIG. 3 is a set of graphs depicting timing information of several waveforms of the ink jet printer of FIG. 1.

On FIG. 3, a typical quadrature waveform is depicted by the curves 102 and 104, in which 102 represents Channel A and 104 represents Channel B. This quadrature output, generally designated by the reference numeral 100, is generated by the encoder sensor 50, and nominally each of the channels has a 50% duty cycle. For Channel A, the first rising edge is depicted at 110, the falling edge at 112, and the next rising edge at 114. The rising edges 110 and 114 are termed "critical edges" with respect to the print timing, as discussed in greater detail hereinbelow. For Channel B, the rising edge is depicted at 120, and its falling edge at 122. Of course, this quadrature waveform continues off the page of FIG. 3 as long as the carrier 10 is moving along the carrier shaft 20 and the encoder sensor 50 is receiving light pulses at its photodiodes 54 and 56.

With a nominal linear encoder strip having 150 slits per inch, the position encoder 50 will exhibit 150 rising edges per inch on each of Channels A and B. If the carrier is moving at its nominal print velocity of 20 ips, then the "on-time" for the first half-period of Channel A will be a time duration of about 166.7 microseconds, as designated by the time mark "T10." If the duty cycle is exactly 50%, then the off-time will be an identical quantity. However, it will be understood that the duty cycle is not guaranteed to be 50%, and in fact the tolerance for this duty cycle can be as high as ±10%.

Since the quadrature waveform 100 is generated based upon light pulse receptions at the photodiodes 54 and 56, the Channel B waveform should have a similar duty cycle as that of Channel A, although its angular relationship will not always be at 90 degrees. If the carrier 10 is moving at a constant velocity along the carrier shaft 20, and if the photodiodes 54 and 56 are set-up properly with respect to the LED 52, then the angular (or timing) relationship between Channels A and B should be close to 90 degrees with respect to their rising edges (e.g., rising edge 110 as compared to rising edge 120). This will not always be exactly 90 degrees, however, and an appreciable error can occur during acceleration or deceleration of the carrier 10. On many ink jet printers, the opposite channel is certainly not guaranteed to be at 90 degrees, and can even have a very large tolerance of ±30 degrees, thereby providing an angular relationship in the range of 60–120 degrees.

To obtain a print resolution of 1200 dots per inch (dpi), the quadrature waveform 100 is divided so that a single period of Channel A, for example, is divided equally into eight (8) smaller periods, such as the time period T11 between the arrows 116 and 118 on FIG. 3. This period T11 is designated as the "fire time" in the present invention, and such terminology is probably used in prior art conventional ink jet printers. In the present invention, the fire time T11 is further sub-divided into twenty-four smaller time periods, each one being called an "address window" and designated on FIG. 3, for example, by the time period "T12." On FIG. 3, a typical firing time for such a nozzle is designated by the time period "T13."

It will be understood that the actual time periods in operational real time for the quadrature waveform, the fire time, the address window, and the firing pulse timing could be easily modified without departing from the principles of the present invention. Moreover, it will also be understood that the dividing ratios between the quadrature clock, inches per second resolution timing, and nozzle spacing and numbers of nozzles in a diagonal row also could be varied without departing from the principles of the present invention.

In a preferred ink jet printer, the ink jet cartridge will contain twenty groups of nozzles that are staggered in a diagonal manner in which each of these twenty groups would have thirty-two individual nozzles, thereby providing a total of six hundred forty (640) nozzles on the cartridge. Since there are twenty different groups of nozzles, there will need to be twenty consecutive time periods that must fall within a single fire time interval, such as fire time interval T11. This timing is not merely a mechanical spacing consideration, but is also a power supply consideration and heat dissipation consideration, such that it is typically best to only have a single group of nozzles being energized at a given instant in time, which means that all of those nozzles must become de-energized before allowing the next group of nozzles to become energized. This is why the twenty consecutive time intervals are required, and that they do not overlap one another. Of course, a nozzle group overlap in actual firing time could be allowed to occur if the physical electrical power supply and heat dissipation properties of the ink jet cartridge nozzle array could withstand such an occurrence.

As discussed above, the fire time period T11 is a quantity that is derived from the Channel A time period. A new calculation of the time value for T11 is computed upon each critical edge of Channel A, i.e., at edges 110 and 114 on FIG. 3. For example, after the critical edge 110 occurs, the time period T11 is computed for all eight of the fire time intervals for that entire Channel A period, until reaching the next critical edge at 114. Once the next critical edge at 114 is reached, the previous time exhibited between the critical edges 110 and 114 is determined, and that time is divided by eight and each of these one-eighth time intervals is used for a similar fire time T11 during the Channel A time interval after the rising edge 114.

If the printer desired to print a pel at the rising edge 114, the printer would use as the fire time T11 for that pel, and the amount of that timing quantity T11 would be determined during the time interval between the critical edges 110 and 114. However, if the printer wanted to print a pel somewhere during the period between the rising edges 110 and 114 (at the falling edge 112, for example), then the fire time interval similar to T11 that would be used to print this pel would be based upon the amount of time (divided by eight) that occurred between the critical edge 110 and the most previous critical edge (not shown) that occurred earlier. Thus, it can be seen that the critical edges of the Channel A waveform are indeed very important for the print timing.

It will further be understood that the fire time intervals are also dependent upon the print resolution, and for a lower resolution (such as 300 dpi), the fire time would be much longer in duration for any given pel, as compared to the fire times depicted on FIG. 3 (at the 1200 dpi resolution).

An address bus timing graph 130 is illustrated on FIG. 3, and represents the timing of sixteen parallel data lines that provide the actual nozzle firing data during each address window that relates to a particular group of nozzles that can be fired of the twenty groups of such staggered nozzles. For example, the third group of nozzles would be fired (or not fired, depending on the print data) during the time interval at 132, and the nineteenth group of nozzles would be fired (or not) at the reference numeral 134. After the twenty address windows have occurred, a "headroom" time interval designated by the reference numeral 136 occurs, which nominally will represent about one-sixth of the time period of the fire time T11. After this headroom interval 136 has occurred, another set of address windows begins, as indicated by the reference numeral 138 for the first group of nozzles that would be fired.

The time interval for each address window is designated at "T12," and using a nominal print speed of 20 ips at a nominal print resolution of 1200 dpi, the address window would be 1.74 microseconds in duration. Assuming that the printer is working at its nominal rate and that there are no errors due to acceleration or other mechanical effects, after twenty of the address windows having a period of T12 have occurred, that should leave a headroom interval, designated by the time mark "T14," of about 7 microseconds. As will be seen hereinbelow, this headroom may be necessary if there has been a velocity carriage overspeed, in order to successfully print all twenty of the address windows for a particular fire time T11. This is very important in the present invention, because the actual fire time at this resolution and print speed will nominally be approximately 1.5 microseconds in duration, as illustrated by the time mark "T13."

The typical print data is illustrated by a graph 140 on FIG. 3. This print data is often referred to as the "p-line data," which stands for "primitive" data. This terminology stems from array-type electronic addressing schemes, in which there are rows and columns, and also primitive data.

With regard to the typical p-line data graph at 140 on FIG. 3, its initial rising edge is designated 142, and this corresponds to the rising edge 116 of the first fire time interval T11. This in turn corresponds to the critical edge 110 of Channel A. If there are to be two consecutive pels to be printed by two consecutive groups of the twenty groups of nozzles, then the nominal fire time of 1.5 microseconds must fall completely within the address window T12, or there will be some type of error in the actual placement of dots on the printed page. In the present invention, it is deemed more important to provide a consistent time duration for each printed pel of 1.5 microseconds, so that the proper amount of ink will be deposited on the paper by the nozzle for each pel. This will not be a problem so long as the address window remains at its nominal 1.74 microseconds in time duration. However, this can change due to velocity errors, particularly where a velocity overspeed occurs that will have the tendency of reducing the amount of time available for each address window in the next time period between critical edges of Channel A. On the graph 140, the falling edge at 144 preferably occurs after 1.5 microseconds, which leaves a small amount of time before the next rising edge at 146. As noted above, the nominal duty cycle is 1.5 microseconds divided by 1.74 microseconds, providing a duty cycle of 86.2%.

In the present invention, it is preferred to calculate the address window time period T12 for all twenty of the address windows that occur during a single fire time interval T11, based upon the most previous time interval between critical edges of Channel A. Therefore, all of the address windows T12 will be of approximately equal time duration for a particular fire time interval T11, and moreover, all of the address windows will be of approximately equal duration for all of the fire time intervals T11 for the entire time period between critical edges of Channel A. The next initial address window after the headroom time interval T14 occurs at 148 on FIG. 3. All of the address windows following this rising edge 148 should be of equal time duration as those address windows that occurred between the rising edges 142 and 148 in this example.

In this configuration, there nominally will be twenty-four possible address windows to deposit twenty possible dot groups of ink during a single fire time interval T11. However, if a velocity carriage overspeed condition occurs, the overall time T11 may not be long enough to provide twenty-four fire windows. This can occur if an error, due to rotational motion on the shaft bearings, occurs that shortens significantly the amount of time between critical edges on Channel A on the quadrature waveform 100. In that event, the headroom of 7 microseconds (at T14) will be sufficient in most cases to allow at least twenty complete address windows T12 to fall within a single fire time interval T11, so that there will be a full duration of fire times T1 3 for each of these twenty address windows.

In the present invention, since it is considered important to provide the nominal amount of fire time at a particular print resolution, the fire times T13 will preferably be observed regardless of whether or not the fire time interval T11 is sufficiently long in duration or not. There may be somewhat of a pel placement error at the end of the time period between critical edges on Channel A due to this design philosophy, but at least the pels that are printed on the paper will have a good appearance, even though they may be somewhat out of place by the end of the time period between Channel A critical edges. This is considered a better situation than having printed pels that exhibit a poor appearance, even though they may have been placed more accurately on the page, i.e., assuming that the relatively quick next critical edge on Channel A that caused the headroom to disappear was actually a true critical edge with respect to real time versus position on the page of the nozzles. Of course, due to some acceleration or deceleration mechanical errors that affect the rotational motion on the shaft bearings, one may assume that some (or most) of these quick timing intervals may be in fact incorrect, and it would be far better to place good pels on the paper at what appears at the time to be a sufficient spacing between pels.

In the present invention, the determination of real time for the quadrature clock 100 is determined by counting very fast clock pulses, and then reading those counts upon the next critical edge transition of Channel A. The hardware to implement the present invention is illustrated in block diagram form on FIG. 4. It is preferred that all of the hardware depicted on FIG. 4 (except for the optical encoder) be part of an ASIC (Application Specific Integrated Circuit) 200, including the microprocessor.

An optical encoder circuit 210 is based upon the encoder sensor 50 of FIG. 1, and has two output signals, Channel A and Channel B. These Channel A and Channel B signals are directed to a filter 212 which removes any spurious signals to eliminate noise from the input signals. Filter 212 has two outputs based upon the Channel A and Channel B inputs, and these signals are called "FA" and "FB," respectively on FIG. 4.

Signals FA and FB are directed to a position counter 214, which keeps track of the linear displacement of the carrier 10 along the carrier shaft 20. The counter's registers can be read by a microprocessor 205 along a bus 216, and microprocessor 205 can also change the values of these counters, particularly when it is desired to place the count values to zero (0), which typically would occur once after reset (of the printer) to establish a home position. The filtered Channel A signal (FA) is also directed to a rising edge detector 220, which provides a one-shot output signal to a velocity counter 222.

Velocity counter 222 provides an output to a pair of holding registers 224, in which the values of these holding registers are fed to microprocessor 205 over a bus 226. The holding registers 224 are used to store the time durations (as a pair of count values) of the previous periods of the Channel A and Channel B quadrature signals. These values are directed to a set of print timing dividers 230.

Print timing dividers 230 divide the count values of the holding registers by a factor of eight, which is a very accurate binary divide. The fire time intervals are derived at this point, such as the time interval T11 on FIG. 3. This information is then directed to a set of fire time dividers 232, which further divide the count values by a factor of 24. This is the derivation of the time intervals for the address windows, such as those windows T12 on FIG. 3. An address window circuit 234 takes this count value and creates a timing clock signal that controls the transition of data on the address bus to the printhead, which is depicted on FIG. 3 as the address bus signals 130. This timing information is then directed to a set of fire pulse drivers 236, which determine the timing of the leading edge of each fire pulse, such as the fire pulse T13 on FIG. 3.

Microprocessor 205 also reads the data provided to the fire pulse drivers 236 over a bus 238. Microprocessor 205 will control the time duration of the fire pulse used by the fire pulse drivers, also via data written to the fire pulse drivers over the bus 238. In this situation, the microprocessor is controlling the desired length of the fire pulse based upon the print resolution of the document being printed. The fire pulse drivers 236 control the energization of the multiple ink jet nozzles 240 by relatively high current signals that pass over the driver lines 242 on FIG. 4.

A high speed clock 250 is provided so that the microprocessor 205 will have a stable clock reference signal, such as provided for virtually all microprocessors. High speed clock 250 is output over a clock line 252 to the microprocessor, although this same high speed clock signal will preferably be fed to other parts of the circuit as well. The high speed clock signal can be particularly useful for the counters, if a high precision count is desired. The holding registers 224 preferably employ 16-bit counters, so that a very large (and therefore, precision) count will take place based upon the velocity counter information.

Figure 4:
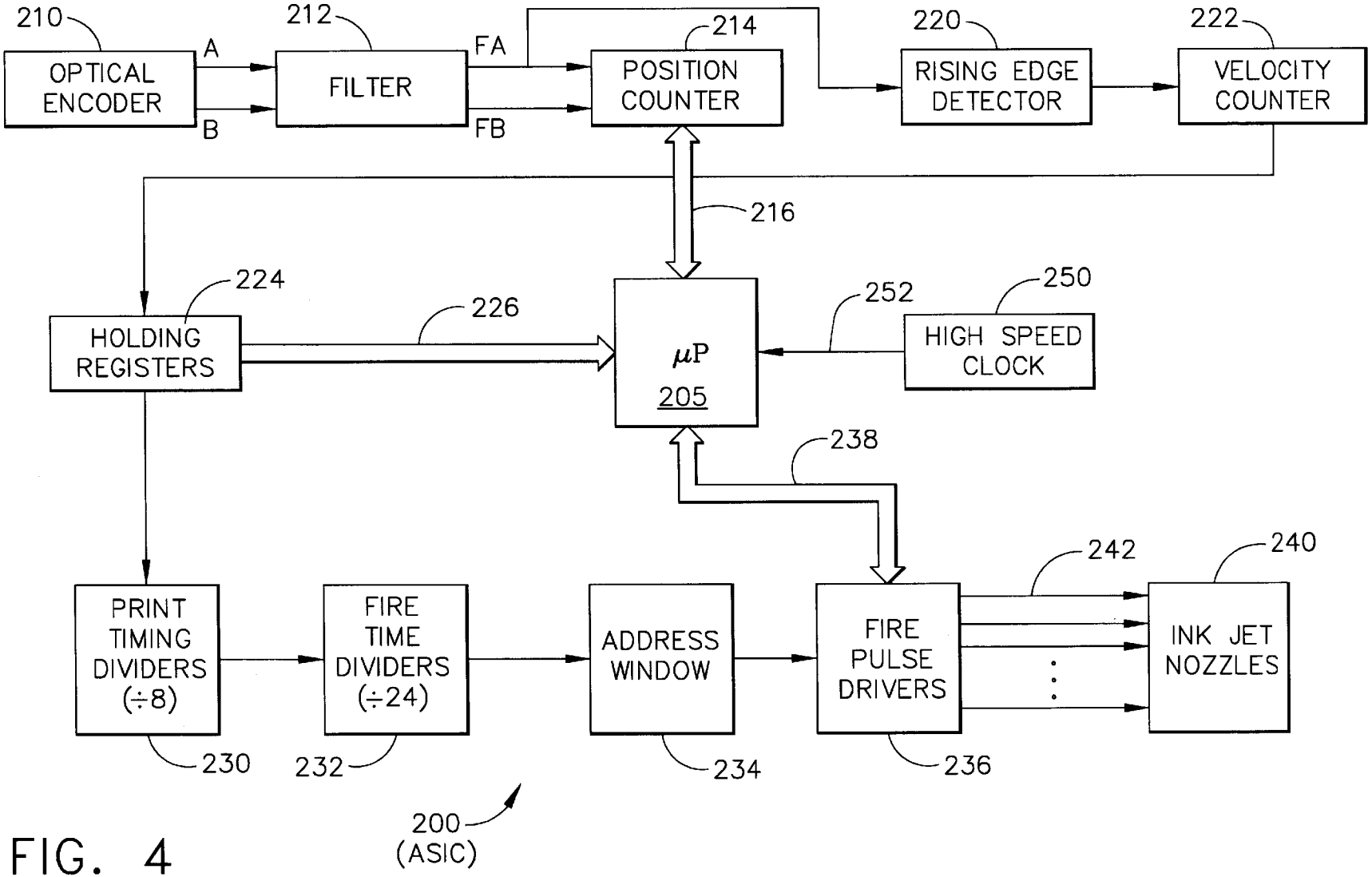
FIG. 4 is a hardware block diagram of the major circuit components of the ink jet printer of FIG. 1, as related to the present invention.
Figure 5:
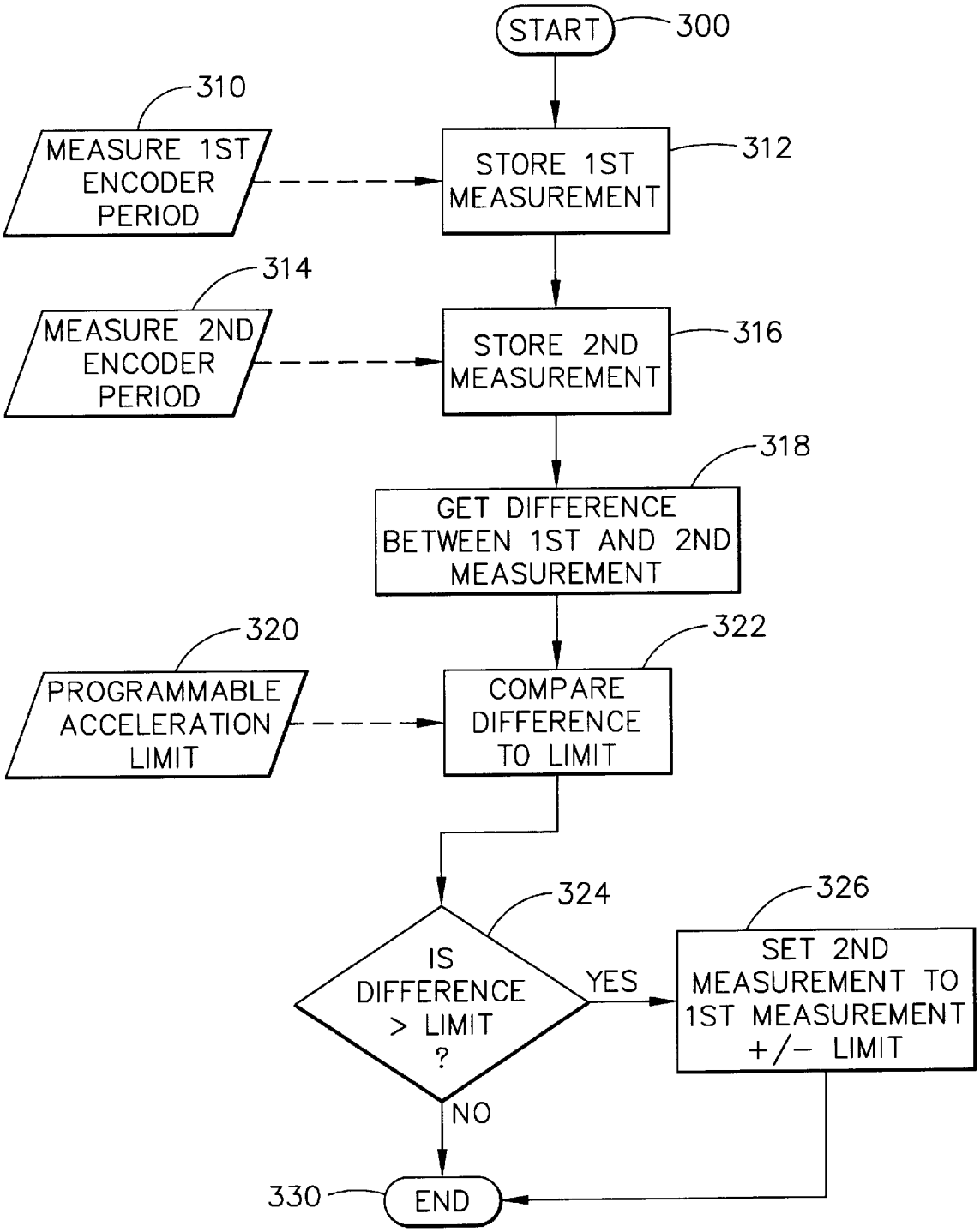
FIG. 5 is a flow chart of some of the important logical steps performed by the ink jet printer of FIG. 1, as related to the present invention.

FIG. 5 is a flow chart showing the important sequential logical operations performed by the circuit illustrated in FIG. 4. The logic routine starts at a step 300, and the first logical operation performed is to measure a first encoder period at a step 310. This first measurement information is stored in the first holding register (of holding registers 224) at a step 312. A second encoder period is measured at a step 314, and this information is stored in the second holding register at a step 316.

The difference between the first and second encoder period measurements is determined at a step 318, which represents the difference between the two count values of the encoder periods. It will be understood that these logical and arithmetic operations preferably are performed by a processing circuit, such as high-speed parallel logic circuitry contained in an ASIC.

A programmable acceleration limit is provided at a step 320. This acceleration limit can be determined by the microprocessor 205, and specifically is usable for different print resolutions and different printing conditions. This acceleration limit information is provided to a step 322 which compares that limit to the difference between the first and second measurements that is provided from the step 318. A decision step 324 compares the difference to the limit, and if the difference is not greater than the acceleration limit, this routine comes to an end at 330.

If the difference between the encoder measurements is greater than the acceleration limit, then the logic flow is directed to a step 326 which sets the second measurement to the first measurement, plus or minus (plus/minus) the acceleration limit. The routine then terminates at 330.

By forcing the second encoder period to effectively fall within a certain tolerance of the first encoder period, the present invention prevents a false critical edge from significantly throwing off the print timing that normally is determined by the rising edge of Channel A (i.e., the critical edge). In conventional printers, as noted above, the print timing is exclusively determined by each of these critical edges from Channel A. In the present invention, false critical edges will not be used as the control condition for the print timing, but instead the programmable acceleration limit will be substituted so that the next encoder period will only be a certain percentage (either greater or lesser) than the previous (or first) encoder period that was determined at step 310.

The greater the acceleration that is to be tolerated for the carrier of an ink jet printer, the greater the plus or minus (plus/minus) tolerance that will likely be allowed for the acceleration limit that is provided at step 320 on FIG. 5. On the other hand, once a carrier of an ink jet printer goes into its constant velocity mode for actual printing, then the acceleration limit can be relatively safely narrowed to a fairly narrow tolerance, and so false critical edges due to rotational motion of shaft bearings on the carrier can more often be eliminated by use of the acceleration limit. The main benefit is to more accurately place the pels that are to be printed on the actual print media, since the true timing of the critical edge cannot physically have been so extremely far off from the programmable limits except due to some type of rotational error effects.

It will be understood that other hardware configurations of an image forming apparatus could be used besides the use of position counters, velocity counters, holding registers, and dividing circuits to determine print timing and fire time for firing pulses, without departing from the principles of the present invention.

Moreover, it will also be understood that a non-programmable logic system could be used and substituted for the microprocessor 205 without departing from the principles of the present invention. Such a non-programmable system could be implemented to act in essence as a band-pass filter with respect to the count values or timing values that are temporarily stored for the purpose of "remembering" the previous two time periods of Channel A of the quadrature clock. In fact, the logical operations as depicted in FIG. 5 could all be virtually done in hard logic using comparators, either analog comparators to measure the difference between voltage levels, or digital comparators to measure the difference between count values, or other binary signal values.

Another optional feature in the present invention is to generate acceleration information from the values in the holding registers, since their values are based upon the velocity history of the carrier 10 as it moves along the carrier shaft 20. This information could be directly fed to the servo motor controller of the printhead carrier, which is a feature that is presently not done in conventional servo controlled ink jet printers.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. An image forming apparatus that automatically compensates for velocity errors in a carrier structure, comprising:

(a) a printhead carrier that includes a plurality of printing elements, said carrier being movable along an axis that is parallel to a direction of printing, said carrier including a position encoder that provides an electrical output signal, said signal exhibiting a plurality of transitions over time;

(b) a time-measuring circuit that detects a status of said position encoder electrical output signal and determines a time interval between at least two successive of said transitions, said time interval being related to a velocity of said carrier, said time-measuring circuit establishing a first time quantity for at least one of said time intervals between two successive of said transitions, and establishing a second time quantity for the next one of said time intervals between two successive of said transitions;

(c) a memory circuit that stores a predetermined error limit related to time;

(d) a comparison circuit that determines if said second time quantity is within a range of {said first time quantity plus/minus said predetermined error limit}, and if so, said comparison circuit providing a print fire time quantity that is based upon said second time quantity, and if not, said comparison circuit providing a print fire time quantity that is based said first time quantity plus/minus said predetermined error limit; and (e) a print fire timing circuit that uses said print fire time quantity as the basis for energizing said printing elements for placement of printed dots upon a print media.

2. The image forming apparatus as recited in claim 1, wherein said plurality of printing elements comprise an array of ink jet nozzles, and wherein said printhead carrier moves along a carrier shaft and holds an ink jet cartridge which includes said array of ink jet nozzles.

3. The image forming apparatus as recited in claim 1, wherein said position encoder comprises an optical encoder that detects lines in a linear encoder strip, and wherein said electrical output signal comprises a quadrature signal.

4. The image forming apparatus as recited in claim 1, wherein said time-measuring circuit comprises a rising edge detector, a high-speed clock, a counter, and two registers.

5. The image forming apparatus as recited in claim 4, wherein said time-measuring circuit further comprises a processing circuit, and wherein said rising edge detector senses positive transitions in said electrical output signal and, upon detection, outputs a one-shot signal to said counter, whereupon said counter begins to count clock periods of said high-speed clock until a next detection of a positive transition in said electrical output signal, then, under the control of said processing circuit, places a count value into one of said two registers, and later resets to zero the count value of the same of said two registers.

6. The image forming apparatus as recited in claim 1, wherein said printing elements each comprise an electrically-energized ink jet nozzle heater that, when energized, sprays a drop of ink.

7. The image forming apparatus as recited in claim 1, wherein said comparison circuit comprises a processing circuit and a plurality of memory locations that hold numeric values related to (i) said first and second time quantities, and (ii) said error limit; said comparison circuit further comprising a dividing circuit that divides said first and second time quantities to produce fire pulse timing.

8. The image forming apparatus as recited in claim 7, wherein said error limit represents a reasonable maximum amount of time that said carrier would vary its velocity due to acceleration forces under printing conditions, but without any error effects due to wobble or other mechanical rotation due to imperfect-tolerance shaft bearings that cause significantly larger deviations in time intervals said transitions of the electrical output signal.

9. The image forming apparatus as recited in claim 7, wherein said error limit represents a maximum change in the amount of time that a printer will use to print pels from one time period to another time period, regardless of actual acceleration forces and other mechanical rotational forces on said carrier.

10. A method for automatically correcting variations in carrier motion that produce corrupted velocity timing signals of an image forming apparatus, said method comprising:

(a) providing an image forming apparatus having a printhead carrier that includes a plurality of printing elements, said carrier being movable along an axis that is parallel to a direction of printing, said carrier including a position encoder that provides an electrical output signal, said signal exhibiting a plurality of transitions over time;

(b) determining a time interval between at least two successive of said transitions of said position encoder electrical output signal, said time interval being related to a velocity of said carrier;

(c) establishing a first time quantity for one of said time intervals between two successive of said transitions, and establishing a second time quantity for the next one of said time intervals between two successive of said transitions;

(d) providing a predetermined error limit related to time;

(e) determining if said second time quantity is within a range of {said first time quantity plus/minus said predetermined error limit}, and (i) if so, providing a print fire time quantity that is based upon said second time quantity, and (ii) if not, providing a print fire time quantity that is based upon said first time quantity plus/minus said predetermined error limit; and (f) energizing, using said print fire time quantity as a basis for time of energization, said printing elements for placement of printed dots upon a print media.

11. The method as recited in claim 10, wherein said plurality of printing elements comprise an array of ink jet nozzles, and wherein said printhead carrier moves along a carrier shaft and holds an ink jet cartridge which includes said array of ink jet nozzles.

12. The method as recited in claim 10, wherein said position encoder comprises an optical encoder that detects lines in a linear encoder strip, and wherein said electrical output signal comprises a quadrature signal.

13. The method as recited in claim 10, wherein said printing elements each comprise an electrically-energized ink jet nozzle heater that, when energized, sprays a drop of ink.

14. The method as recited in claim 10, further comprising:

(a) detecting positive transitions in said electrical output signal and, upon detection, outputting a one-shot signal to a counter, whereupon said counter begins to count clock periods of a high-speed clock until a next detection of a positive transition in said electrical output signal;

(b) placing a count value into one of a first register and a second register, and later resetting to zero the count value of the same of said first and second registers;

(c) holding in memory locations numeric values related to (i) said first and second time quantities, and (ii) said error limit; and (d) dividing said first and second time quantities to produce fire pulse timing.

15. The method as recited in claim 14, wherein said error limit represents a reasonable maximum amount of time that said carrier would vary its velocity due to acceleration forces under printing conditions, but without any error effects due to wobble or other mechanical rotation due to imperfect-tolerance shaft bearings that cause significantly larger deviations in time intervals said transitions of the electrical output signal.

16. The method as recited in claim 14, wherein said error limit represents a maximum change in the amount of time that a printer will use to print pels from one time period to another time period, regardless of actual acceleration forces and other mechanical rotational forces on said carrier.

17. A method for automatically correcting for fire pulse times of an image forming apparatus due to variations in carrier motion that produce corrupted velocity timing signals, said method comprising:

(a) providing an image forming apparatus having a printhead carrier that includes a plurality of printing elements, said carrier being movable along an axis that is parallel to a direction of printing, said carrier including a position encoder that provides an electrical output signal;

(b) measuring a difference between two successive time intervals of a plurality of periodic transitions of said electrical output signal, and if said difference is greater than a predetermined time quantity, limiting a second of said two successive time intervals to a value that is within a tolerance equal to {a first of said two successive time intervals plus/minus said predetermined time quantity}; and (c) energizing, using said second of said two successive time intervals as a basis for time of energization, said printing elements for placement of printed dots upon a print media.

18. The method as recited in claim 17, wherein said plurality of printing elements comprise an array of ink jet nozzles, and wherein said printhead carrier moves along a carrier shaft and holds an ink jet cartridge which includes said array of ink jet nozzles.

19. The method as recited in claim 17, wherein said position encoder comprises an optical encoder that detects lines in a linear encoder strip, and wherein said electrical output signal comprises a quadrature signal.

20. The method as recited in claim 17, wherein said printing elements each comprise an electrically-energized ink jet nozzle heater that, when energized, sprays a drop of ink.

21. The method as recited in claim 17, further comprising:

(a) detecting positive transitions in said electrical output signal and, upon detection, outputting a one-shot signal to a counter, whereupon said counter begins to count clock periods of a high-speed clock until a next detection of a positive transition in said electrical output signal;

(b) placing a count value from said counter into one of a first register and a second register, and later resetting to zero the count value of the same of said first and second registers;

(c) holding in memory locations numeric values related to (i) said first and second count values, and (ii) said predetermined time quantity; and (d) dividing said second of said two successive time intervals to produce fire pulse timing.

22. The method as recited in claim 21, wherein said predetermined time quantity represents a reasonable maximum amount of time that said carrier would vary its velocity due to acceleration forces under printing conditions, but without any error effects due to wobble or other mechanical rotation due to imperfect-tolerance shaft bearings that cause significantly larger deviations in time intervals said transitions of the electrical output signal.

23. The method as recited in claim 21, wherein said predetermined time quantity represents a maximum amount of time that a printer will be allowed to print pels from one time period to another time period, regardless of actual acceleration forces and other mechanical rotational forces on said carrier.

* * * * *